US009428857B2

(12) United States Patent
De Vos

(10) Patent No.: US 9,428,857 B2
(45) Date of Patent: Aug. 30, 2016

(54) WOVEN CARPET COATING COMPOUNDS, ASSOCIATED METHODS OF USE, AND ARTICLES MADE THEREFROM

(75) Inventor: Hans De Vos, Horgen (CH)

(73) Assignee: Dow Global Technologies LLC, Midland, MI (US)

( * ) Notice: Subject to any disclaimer, the term of this patent is extended or adjusted under 35 U.S.C. 154(b) by 831 days.

(21) Appl. No.: 13/141,052

(22) PCT Filed: Dec. 21, 2009

(86) PCT No.: PCT/US2009/068923
§ 371 (c)(1),
(2), (4) Date: Jun. 20, 2011

(87) PCT Pub. No.: WO2010/075251
PCT Pub. Date: Jul. 1, 2010

(65) Prior Publication Data

US 2011/0256788 A1 Oct. 20, 2011

Related U.S. Application Data

(60) Provisional application No. 61/139,749, filed on Dec. 22, 2008.

(51) Int. Cl.
*D06N 7/00* (2006.01)
*B05D 5/10* (2006.01)

(52) U.S. Cl.
CPC ..... *D06N 7/0073* (2013.01); *D06N 2203/042* (2013.01); *D06N 2205/04* (2013.01); *D06N 2209/0861* (2013.01); *Y10T 442/20* (2015.04); *Y10T 442/291* (2015.04)

(58) Field of Classification Search
CPC ..... B32B 27/04; B32B 27/06; B32B 27/08; B32B 27/12; B32B 27/18; B32B 27/32; B05D 3/02; B05D 3/0254; B05D 5/10; D06N 7/0073; D06N 2203/042; D06N 2205/02; D06N 2205/023
USPC ..... 442/59, 170, 149; 427/207.1, 372.2; 428/97, 95
See application file for complete search history.

(56) References Cited

U.S. PATENT DOCUMENTS 3,645,992 A 2/1972 Elston
3,811,922 A * 5/1974 Clark ..... D06N 7/0073 427/373

(Continued)

FOREIGN PATENT DOCUMENTS

EP 1008689 6/2000
JP 59214633 12/1984

(Continued)

OTHER PUBLICATIONS

PCT Search Report from counterpart PCT Application No. PCT/US2009/068923, dated Mar. 19, 2010, 3 pages.

(Continued)

*Primary Examiner* — Cheryl Juska

(57) ABSTRACT

A method of preparing a woven carpet comprising applying a coating compound as an adhesive layer to the woven carpet to form a coated woven carpet, wherein the coating compound comprises an aqueous dispersion comprising a base polymer, a stabilizing agent, and a liquid medium, wherein the base polymer comprises a polyolefin-based polymer; and a wetting agent. A woven carpet comprising a woven substrate; and an adhesive layer comprising a dehydration product of a coating compound comprising an aqueous dispersion comprising a base polymer, a stabilizing agent, and a liquid medium, wherein the base polymer comprises a polyolefin-based polymer; and a wetting agent.

15 Claims, 3 Drawing Sheets

(56) References Cited

U.S. PATENT DOCUMENTS

| | | | | |
|---|---|---|---|---|
| 4,076,698 | A | 2/1978 | Anderson et al. | |
| 4,239,563 | A * | 12/1980 | Iacoviello | C09J 1232/08 156/332 |
| 4,599,392 | A | 7/1986 | McKinney et al. | |
| 4,988,781 | A | 1/1991 | McKinney et al. | |
| 5,272,236 | A | 12/1993 | Lai et al. | |
| 5,278,272 | A | 1/1994 | Lai et al. | |
| 5,504,172 | A | 4/1996 | Imuta et al. | |
| 5,677,383 | A | 10/1997 | Chum et al. | |
| 5,756,659 | A | 5/1998 | Hughes et al. | |
| 5,844,045 | A | 12/1998 | Kolthammer et al. | |
| 5,869,575 | A | 2/1999 | Kolthammer et al. | |
| 5,938,437 | A | 8/1999 | DeVincenzo | |
| 6,111,023 | A | 8/2000 | Chum et al. | |
| 6,316,549 | B1 | 11/2001 | Chum et al. | |
| 6,448,341 | B1 | 9/2002 | Kolthammer et al. | |
| 6,455,636 | B2 | 9/2002 | Sanada | |
| 6,525,157 | B2 | 2/2003 | Cozewith et al. | |
| 6,538,070 | B1 | 3/2003 | Cardwell et al. | |
| 6,566,446 | B1 | 5/2003 | Parikh et al. | |
| 6,960,635 | B2 | 11/2005 | Stevens et al. | |
| 7,135,214 | B1 * | 11/2006 | Smith | B32B 5/26 428/95 |
| 7,645,521 | B2 * | 1/2010 | Wevers et al. | 428/523 |
| 7,799,864 | B2 * | 9/2010 | Wevers | C08L 23/0815 28/159 |
| 7,947,679 | B2 * | 5/2011 | Crowley | C07D 471/04 514/234.2 |
| 8,043,713 | B2 * | 10/2011 | Wevers et al. | 428/523 |
| 8,735,471 | B2 * | 5/2014 | Menning | C08J 9/28 521/144 |
| 2002/0134486 | A1 * | 9/2002 | Brumbelow | B32B 5/022 156/79 |
| 2005/0100754 | A1 * | 5/2005 | Moncla | C08J 7/047 428/523 |
| 2006/0199930 | A1 | 9/2006 | Li Pi Shan et al. | |
| 2007/0141323 | A1 * | 6/2007 | Wevers et al. | 428/323 |
| 2008/0292833 | A1 * | 11/2008 | Wevers et al. | 428/96 |
| 2009/0278074 | A1 * | 11/2009 | Cox et al. | 252/67 |
| 2010/0062209 | A1 * | 3/2010 | Wevers | C08L 23/0815 428/95 |
| 2010/0285253 | A1 | 11/2010 | Hughes | |
| 2010/0310858 | A1 * | 12/2010 | Wevers | C08L 23/0815 428/327 |
| 2012/0325403 | A1 * | 12/2012 | Chereau | B32B 27/12 156/285 |
| 2013/0344281 | A1 * | 12/2013 | Wright | B29B 17/02 428/95 |
| 2014/0058034 | A1 * | 2/2014 | Moncla | C08J 7/047 524/563 |
| 2014/0087120 | A1 * | 3/2014 | Sagl | D06N 7/0073 428/96 |
| 2014/0134386 | A1 * | 5/2014 | Brumbelow | B32B 5/022 428/95 |

FOREIGN PATENT DOCUMENTS

| | | |
|---|---|---|
| JP | 2000008278 | 11/2000 |
| JP | 2005060888 A * | 3/2005 |
| WO | 0001745 | 1/2000 |
| WO | WO2005/021622 | 3/2005 |
| WO | 2005090427 | 9/2005 |
| WO | 2007075279 | 7/2007 |
| WO | 2009067337 | 5/2009 |

OTHER PUBLICATIONS

Chinese Second Office Action dated Jan. 7, 2013; from Chinese counterpart Application No. 200980156459.8.

EP Office Action dated Oct. 19, 2012; from EP counterpart Application No. 09 796 235.1.

Instructions to EP Office Action dated Feb. 12, 2013; from EP counterpart Application No. 09 796 235.1.

Instructions to JP Office Action dated Feb. 12, 2013; from Japanese counterpart Application No. 2011-542531.

Instructions to Chinese Office Action dated Mar. 13, 2013; from Chinese counterpart Application No. 200980156459.8.

Chinese Third Office Action dated Jul. 16, 2013; from Chinese counterpart Application No. 200980156459.8.

Japanese Office Action dated Dec. 11, 2012; from JP counterpart Application No. 2011-542531.

PCT Search Report from counterpart PCT Application No. PCT/US2009/068923 dated Mar. 19, 2010, 2 pages.

International Preliminary Report on Patentability from counterpart PCT Application No. PCT/US2009/068923 dated Jun. 29, 2011, 7 pages.

Chinese First Office Action dated Jun. 19, 2012; from counterpart CN application No. 200980156459.8.

Response to EP Office Action dated Dec. 30, 2011 from counterpart EP application 09796235.1, 3 pages.

Brentin, R.P., "Latex Coating Systems for Carpet Backing", Journal of Coated Fabrics, vol. 12, Oct. 1982, 10 pages.

Fitzgerald, P.L., "Integral Latex Foam Carpet Cushioning", Journal of Coated Fabrics, vol. 7, Oct. 1977, 14 pages.

EP Claim Amendments before Examination for counterpart EP Application No. 09796235.1, dated Jun. 21, 2011, 3 pages.

JP Office Action dated Dec. 17, 2013; from JP counterpart Application No. 2011-542531.

Instructions to JP Office Action dated Mar. 31, 2014; from JP counterpart Application No. 2011-542531.

Chinese Office Action dated Jan. 23, 2014; from Chinese counterpart Application No. 200980156459.8.

Instructions to Chinese Office Action dated Mar. 31, 2014; from Chinese counterpart Application No. 200980156459.8.

Instructions to Chinese Office Action dated Sep. 28, 2014; from counterpart Chinese Application No. 200980156459.8.

Response to Chinese Office Action dated Sep. 30, 2014; from counterpart Chinese Application No. 200980156459.8.

Japanese Office Action dated May 12, 2015 for Japanese Application No. 2014-085368, 3 pages.

Response to Japanese Office Action dated May 12, 2015 filed Aug. 12, 2015 for Japanese Application No. 2014-085368, 5 pages.

EPO Communication pursuant to Article 94(3) EPC dated Jul. 7, 2015 for European Application No. 09796235.1, 4 pages.

Chinese Divisional Office Action dated Jan. 4, 2016; from Chinese Divisional counterpart Application No. 201410521517.5.

* cited by examiner

WOVEN CARPET COATING COMPOUNDS, ASSOCIATED METHODS OF USE, AND ARTICLES MADE THEREFROM

CROSS-REFERENCE TO RELATED APPLICATIONS

This application is a National Stage Entry of PCT/US09/068923, filed on Dec. 21, 2009, and claims the benefit of U.S. Provisional Patent Application Ser. No. 61/139,749, filed Dec. 22, 2008, the entire disclosure of which is hereby incorporated by reference.

BACKGROUND

The present invention relates generally to coating compounds containing aqueous polyolefin dispersions. In particular, at least in some embodiments, the coating compounds of the present invention may be useful for coating woven carpets.

Generally speaking, woven carpets may be produced on a loom similar to how a woven cloth is produced. Coatings can be applied to either the front side or the back side of the carpet to enhance certain properties. For instance, to provide adhesive bonding, a coating compound may be applied to the carpet. Among other things, the coating compound may bond the warp and weft yarns in the woven carpet. Typical coating compounds include latex, urethane, or vinyl systems, with latex being most common. Examples of typical latexes that may be used are carboxylated styrene-butadiene ("SB") or acrylate latex adhesives. Conventional latex systems are low-viscosity, aqueous compositions that can be applied at high carpet production rates. The carpet typically passes through an oven that dries the latex on the carpet. The coating compound may be applied as a single coating or layer or as a multiple layered system.

As the use of polyolefin fibers in carpets has become more popular, the use of carboxylated SB and acrylate-based latex coating compounds on a polyolefin substrate has presented challenges. This is believed to be due, at least in part, to the relative incompatibility of the apolar polyolefin fibers and the more polar polymer in the coating compound. This incompatibility is believed to result in weak associations between the fibers and the latex coating compounds. One of the practical results of this is an increased incidence of carpet fraying. When carpet is manufactured, it has a raw edge that if it is not protected will fray. Although this fraying phenomena can also be observed with naturals yarns (like jute and cotton) or relative polar polymer yarns (like nylon and polyester), most fraying occurs as a result of the combination of apolar yarns (like polypropylene and other polyolefin copolymers) and carboxylated SB- and acrylate-based latex coating compounds.

To combat these problems with latex coating compounds, polyolefin-based coating compounds have become more prevalent. Additionally, those in the art have tried to combat the fraying problems by controlling the degree of yarn coverage. The degree of yarn coverage in the woven fabric is controlled by three parameters: wetting ability, viscosity, and applied dry coat weight. Another technique to protect the edge of the carpet against fraying has involved application of a serge strip on the edge of the carpet.

SUMMARY

The present invention relates generally to coating compounds containing aqueous polyolefin dispersions. In particular, at least in some embodiments, the coating compounds of the present invention may be useful for coating woven carpets.

An embodiment of the present invention provides a method of preparing a woven carpet comprising: applying a coating compound as an adhesive layer to the woven carpet to form a coated woven carpet, wherein the coating compound comprises: an aqueous dispersion comprising a base polymer, a stabilizing agent, and a liquid medium; and a wetting agent, wherein the base polymer comprises a polyolefin-based polymer.

Another embodiment of the present invention provides a textile article: comprising a substrate; and an adhesive layer comprising a dehydration product of a coating compound comprising: an aqueous dispersion comprising a base polymer, a stabilizing agent, and a liquid medium; and a wetting agent, wherein the base polymer comprises a polyolefin-based polymer.

Another embodiment of the present invention provides a woven carpet comprising: a woven substrate; and an adhesive layer comprising a dehydration product of a coating compound comprising: an aqueous dispersion comprising a base polymer, a stabilizing agent, and a liquid medium; and a wetting agent, wherein the base polymer comprises a polyolefin-based polymer.

Another embodiment of the present invention provides a woven carpet comprising a woven substrate; and a coating comprising a base polymer and a wetting agent, wherein the base polymer comprises a polyolefin-based polymer.

The features and advantages of the present invention will be readily apparent to those skilled in the art. While numerous changes may be made by those skilled in the art, such changes are within the spirit of the invention.

BRIEF DESCRIPTION OF THE DRAWINGS

These drawings illustrate certain aspects of some of the embodiments of the present invention, and should not be used to limit or define the invention.

DETAILED DESCRIPTION

Figure 1:
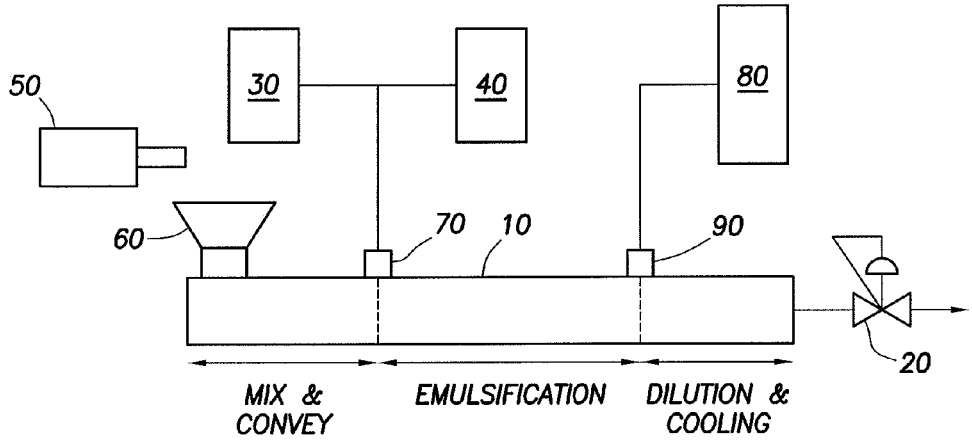
FIG. 1 illustrates an extruder that may be used in accordance with embodiments of the present invention.

The present invention relates generally to coating compounds containing aqueous polyolefin dispersions, in particular, at least in some embodiments, the coating compounds of the present invention may be useful for coating woven carpets.

Of the many advantages of embodiments of the present invention, many of which are not mentioned or alluded to herein, is the ability to provide coating compounds and methods that should enable the production of broad loom woven carpet that is non-fraying, as well as the potential to make rugs out of these broad looms on site, eliminating the need for expensive serging of the edges. This is due at least in part to the optimized coating compounds of the present invention, which should provide sufficient yarn coverage, as well as adhesive (between yarn and coating) and cohesive (within coating) bonding to improve the fray resistance. Additionally, another potential advantage associated with embodiments of the present invention is that the coating compounds should produce a transparent non-hazy, non-tacky film on the carpet, which is desirable in that it allows strike through of flat woven carpets, or even application of a top coating instead of back coating, and can contribute to enhancement of the brightness of such carpet. Because the polymer film from the polyolefin-based dispersion generally does not contain discrete polymer particles, the typical Tyndall effect should not be present and therefore the color of the carpet should be enhanced or less dull. The Tyndall effect is the blue haze that can be observed with latex-based films. Due to absence of the Tyndall effect, he polymer film from the polyolefin-based dispersion is clear and fully transparent. It is also believed that embodiments of the coating compounds of the present invention should provide enhanced resistance to water and stains, like wine, coffee, oil, etc, to substrates on which the coating compounds are placed. Another potential advantage of the present invention is that carpets that are made using embodiments of the coating compounds of the present invention may be easily recycled into resin-based fibers, using trim and other carpet waste from the manufacturing process as well as carpets that are at the end of their serviceable lives.

Glossary of Certain Terms

All numbers disclosed herein are approximate values, regardless of whether the word "about" or "approximate" is used in connection therewith. They may vary by 1%, 2%, 5%, or, sometimes, 10% to 20%. Whenever a numerical range with a lower limit and an upper limit is disclosed, any number failing within the range is specifically disclosed.

The term "average particle size," as used herein, refers to the volume-mean particle size. In order to measure the particle size, laser-diffraction techniques may be employed, for example. A particle size in this description refers to the diameter of the base polymer in the aqueous dispersion. For polymer particles that are not spherical, the diameter of the particle is the average of the long and short axes of the particle. Particle sizes can be measured on a Beckman-Coulter LS230 laser-diffraction particle size analyzer or other suitable device.

The term "coating compound," as used herein, refers to a composition suitable for bonding substrates together. The term coating compound is not intended to imply any particular bonding mechanism. Moreover, the term coating compound is not intended to imply any particular degree of coverage of the woven carpet by the compound.

The term "comonomer," as used herein, refers to a monomer that is mixed with another monomer for a polymerization reaction, The term "copolymer," as used herein, refers to a polymer derived from more than one species of monomer, which would include, but is not limited to, a polymer that has repeat units based on more than one type of monomer.

The term "defoaming agent," as used herein, refers to a composition for preventing foam formation.

The term "dispersion," as used herein, refers to a finely divided solid or liquid in a continuous medium. The term "dispersion" is intended to include both emulsions of essentially liquid materials and dispersions of solid particles.

The term "dispersing agent," as used herein, refers to a composition for promoting dispersion of filler particles in a suspension and/or maintaining a dispersion of filler particles in a suspension.

The term "filling," as used herein, refers to a yarn in a woven fabric running from selvage at right angles to the warp. Each crosswide length is called pick. In the weaving process, the filling yarn may be carried by the shuttle or other type of yarn carrier.

The term "foaming agent," as used herein, refers to a composition for facilitating formation of a foam.

The term "fraying," as used herein, is the slipping or unraveling of yarn from unfinished edges.

The term "graft monomer," as used herein, refers to a species connected to a main polymer chain as a side chain and having constitutional or configurational features that differ from the main chain.

The term "pile," as used herein, refers to an additional set of (mostly thicker) yarns that forms the decorative face, floating on the surface of the carpet. The pile yarn is used in both the warp and the filling.

The term "polyethylene-based copolymer," as used herein, refers to a copolymer containing at least 51% by weight ethylene-derived units.

The term "polypropylene-based copolymer," as used herein, refers to a copolymer containing at least 51% by weight propyl ene-derived units.

The term "stabilizing agent," as used herein, refers to a composition that should allow the base polymer to be suspended in the liquid media. The stabilizing agent therefore disperses the polymer particle, and the dispersing agent disperses the filler particle (where the filler can be of polymeric or inorganic material).

The term "substantially isotactic propylene sequences," as used herein, means that the sequences have an isotactic triad (min) measured by $^{13}C$ NMR of greater than about 0.85; in the alternative, greater than about 0.90; in another alternative, greater than about 0.92; and in another alternative, greater than about 0.93, The term "warp," as used herein refers to the set of yarn in all woven fabrics that runs lengthwise and parallel to the selvage and is interwoven with the filling.

The term "weft," as used herein, is synonymous with the term filling.

The term "wetting agent," as used herein, refers to a surfactant, or surfactants, that when added to a liquid, should cause the liquid to spread more evenly over, or to penetrate, a solid surface.

The term "woven," as used herein, refers to the method or process of interlacing two yarns so that they cross each other to produce woven fabric. The warp yarns, or ends, run lengthwise in the fabric and the filling threads (weft) or picks, run from side to side.

The term "velveting," as used herein, refers to the fraying of the pile caused by brushing the side of the carpet resulting in a rich fabric appearance.

Examples of Coating Compounds

Embodiments of the present invention provide coating compounds that comprise an aqueous dispersion and a wetting agent, wherein the aqueous dispersion comprises a base polymer, a stabilizing agent, an optional base, and a liquid media. As described above, in some embodiments, these coating compounds may be used, for example, to bond the warp and the weft yarns in a woven carpet. These coating compounds may also be suitable for use with needle punch, and/or tufted carpets, including artificial turf.

Although the coating compounds of the present invention have been discussed in terms of their use in woven carpet applications, these coating compounds and methods may also be useful in the coating of tufted carpet as primary or secondary backing adhesive and adhesion of polyolefin films or extrudates to apolar substrates (e.g., polyolefin copolymers) in applications including, but not limited to, tufted yarn, fiber, tape or fleece in primary/secondary backing or non woven textiles. As an example, the coating compounds of the present invention may be useful as a primary coating in the adhesion of polyolefin yarns to a primary backing, or the adhesion of a polyolefin secondary backing to a polyolefinic primary backing. Also adhesion to polar substrates like polyamide 4-6 or polyamide 6-6, and even glass or metal fibers or substrates can be accomplished. Other uses may be evident to one skilled in the art with the benefit of this disclosure, such as for example, in adhesion processes for non-polyolefinic materials.

Examples of Aqueous Dispersions

The aqueous dispersion of the coating compounds may comprise a base polymer, a stabilizing agent, an optional base, and a liquid media. The aqueous dispersion may be present in the coating compounds of the present invention in an amount of about 10% to about 100% by weight of the coating compound, for example. All individual values and subranges from about 10% to about 100% by weight are included herein and disclosed herein; for example, the aqueous dispersion may be present from a lower limit of about 20% by weight, about 40% by weight, about 60% by weight, about 80% by weight to an upper limit of about 20% by weight, about 40% by weight, about 60% by weight, about 80% by weight. For example, the aqueous dispersion may be present in an amount of about 65% to about 100% by weight or in an amount of about 90% to about 100% by weight of the coating compound.

In general, the base polymer should be a polyolefin-based polymer, such as an ethylene-based copolymer, a propylene-based copolymer, or an ethylene-propylene copolymer. In certain embodiments, more than one polyolefin may be present in the aqueous dispersion. In certain embodiments, the polyolefins may comprise alpha-olefin polymers and copolymers, such as ethylene-alpha olefin copolymers and propylene-alpha olefin copolymer. An ethylene-propylene-diene terpolymer may also be used in certain embodiments. In some embodiments, suitable polyolefins include: homogenous polymers described in U.S. Pat. No. 3,645,992, the disclosure of which is incorporated herein by reference; high-density polyethylene ("HDPE") described in U.S. Pat. No. 4,076,698, the disclosure of which is incorporated herein by reference; heterogeneously branched linear low density polyethylene ("LLDPE"); heterogeneously branched ultra low linear density polyethylene ("ULDPE"); homogeneously branched, linear ethylene/alpha-olefin copolymers; homogeneously branched, substantially linear ethylene/alpha-olefin polymers, which can be prepared, for example, by a process disclosed in U.S. Pat. Nos. 5,272,236 and 5,278,272, the disclosures of which are incorporated herein by reference; and high pressure, free radical polymerized ethylene polymers and copolymers such as low density polyethylene ("LDPE"). Polymers described in U.S. Pat. No. 6,538,070, 6,566,446, 5,869,575, 6,448,341, 5,677,383, 6,316,549, 6,111,023, or 5,844,045, each of which is incorporated herein by reference, are also suitable for use, in some embodiments, As noted above, the base polymer may comprise a polymer blend, in accordance with embodiments of the present invention. In some embodiments, the blend may comprise two different Ziegler-Matta polymers. In other embodiments, the blend may comprise a Ziegler-Matta polymer and a metallocene polymer. In still other embodiments, the blend may comprise two different metallocene polymers. While Ziegler-Natta and metallocene polymers are discussed, those of ordinary skill in the art, with the benefit of this disclosure, will appreciate that single site catalysts may also be used.

In some embodiments, the base polymer may comprise a propylene-based copolymer, such as a propylene/alpha-olefin copolymer. In certain embodiments, the propylene/alpha-olefin copolymer is characterized as having substantially isotactic propylene sequences. "Substantially isotactic propylene sequences" means that the sequences have an isotactic triad (mm) measured by $^{13}C$ NMR of greater than about 0.85; in the alternative, greater than about 0.90; in another alternative, greater than about 0.92; and in another alternative, greater than about 0.93. Isotactic triads are well-known in the art and are described in, for example, U.S. Pat. No. 5,504,172 and International Publication No. WO 00/01745, Which refer to the isotactic sequence in terms of a triad unit in the copolymer molecular chain determined by $^{13}C$ NMR spectra.

The propylene/alpha-olefin copolymer has a melt flow rate in the range of from 0.1 to 15 g/10 minutes, measured in accordance with ASTM D-1238 (at 230° C./2.16 Kg), All individual values and subranges from 0.1 to 15 g/10 minutes are included herein and disclosed herein; for example, the melt flow rate can be from a lower limit of 0.1 g/10 minutes, 0.2 g/10 minutes, or 0.5 g/10 minutes to an upper limit of 15 g/10 minutes, 10 g/10 minutes, 8 g/10 minutes, or 5 g/10 minutes. For example, the propylene/alpha-olefin copolymer may have a melt flow rate in the range of 0.1 to 10 g/10 minutes; or in the alternative, the propylene/alpha-olefin copolymer may have a melt flow rate in the range of 0.2 to 10 g/10 minutes.

The propylene/alpha-olefin copolymer has a crystallinity in the range of from at least 1 percent by weight (a heat of fusion of at least 2 Joules/grain) to 30 percent by weight (a heat of fusion of less than 50 Joules/gram). All individual values and subranges from 1 percent by weight (a heat of fusion of at least 2 Joules/gram) to 30 percent by weight (a heat of fusion of less than 50 Joules/gram) are included herein and disclosed herein; for example, the crystallinity can be from a lower limit of 1 percent by weight (a heat of fusion of at least 2 Joules/gram), 2.5 percent (a heat of fusion of at least 4 Joules/gram), or 3 percent (a heat of fusion of at least 5 Joules/gram) to an upper limit of 30 percent by weight (a heat of fusion of less than 50 Joules/gram), 24 percent by weight (a heat of fusion of less than 40 Joules/gram), 15 percent by weight (a heat of fusion of less than 24.8 Joules/gram) or 7 percent by weight (a heat of fusion of less than 11 Joules/gram), For example, the propylene/alpha-olefin copolymer may have a crystallinity in the range of from at least 1 percent by weight (a heat of fusion of at least 2 Joules/gram) to 24 percent by weight (a heat of fusion of less than 40 Joules/gram); or in the alternative, the propylene/alpha-olefin copolymer may have a crystallinity in the range of from at least 1 percent by weight (a heat of fusion of at least 2 Joules/gram) to 15 percent by weight (a heat of fusion of less than 24.8 Joules/gram); or in the alternative, the propylene/alpha-olefin copolymer may have a crystallinity in the range of from at least 1 percent by weight (a heat of fusion of at least 2 Joules/gram) to 7 percent by weight (a heat of fusion of less than 11 Joules/gram); or in the alternative, the propylene/alpha-olefin copolymer may have a crystallinity in the range of from at least 1 percent by weight (a heat of fusion of at least 2 Joules/gram) to 5 percent by weight (a heat of fusion of less than 8.3 Joules/gram), The crystallinity is measured via DSC method, as described above.

The propylene/alpha-olefin copolymer comprises units derived from propylene and polymeric units derived from one or more alpha-olefin comonomers, Exemplary comonomers utilized to manufacture the propylene/alpha-olefin copolymer are $C_2$, and $C_4$ to $C_{10}$ alpha-olefins; for example, $C_2$, $C_4$, $C_6$ and $C_8$ alpha-olefins.

The propylene/alpha-olefin copolymer comprises from 1 to 40 percent by weight of one or more alpha-olefin comonomers. All individual values and subranges from 1 to 40 weight percent are included herein and disclosed herein; for example, the comonomer content can be from a lower limit of 1 weight percent, 3 weight percent, 4 weight percent, 5 weight percent, 7 weight percent, or 9 weight percent to an upper limit of 40 weight percent, 35 weight percent, 30 weight percent, 27 weight percent, 20 weight percent, 15 weight percent, 12 weight percent, or 9 weight percent. For example, the propylene/alpha-olefin copolymer comprises from 1 to 35 percent by weight of one or more alpha-olefin comonomers; or in the alternative, the propylene/alpha-olefin copolymer comprises from 1 to 30 percent by weight of one or more alpha-olefin comonomers; or in the alternative, the propylene/alpha-olefin copolymer comprises from 3 to 27 percent by weight of one or more alpha-olefin comonomers; or in the alternative, the propylenelalpha-olefin copolymer comprises from 3 to 20 percent by weight of one or more alpha-olefin comonomers; or in the alternative, the propylene/alpha-olefin copolymer comprises from 3 to 15 percent by weight of one or more alpha-olefin comonomers, The propylene/alpha-olefin copolymer has a molecular weight distribution (MWD), defined as weight average molecular weight divided by number average molecular weight ($M_w/M_n$) of 3.5 or less; in the alternative 3.0 or less; or in another alternative from 1.8 to 3.0.

Such propylene/alpha-olefin copolymers are further described in details in the U.S. Pat. Nos. 6,960,635 and 6,525,157, incorporated herein by reference. Such propylene/alpha-olefin copolymers are commercially available from The Dow Chemical Company, under the tradename VERSIFY™, or from ExxonMobil Chemical Company, under the tradename VISTAMAXX™, In one embodiment, the propylene/alpha-olefin copolymers are further characterized as comprising (A) between 60 and less than 100, preferably between 80 and 99 and more preferably between 85 and 99, weight percent units derived from propylene, and (B) between greater than zero and 40, preferably between 1 and 20, more preferably between 4 and 16 and even more preferably between 4 and 15, weight percent units derived from at least one of ethylene and/or a $C_{4-10}$ α-olefin; and containing an average of at least 0.001, preferably an average of at least 0.005 and more preferably an average of at least 0.01, long chain branches/1000 total carbons. The maximum number of long chain branches in the propylene interpolymer is not critical to the definition of this invention, but typically it does not exceed 3 long chain branches/1000 total carbons. The term long chain branch, as used herein, refers to a chain length of at least one (1) carbon more than a short chain branch, and short chain branch, as used herein, refers to a chain length of two (2) carbons less than the number of carbons in the comonomer. For example, a propylene/1-octene interpolymer has backbones with long chain branches of at least seven (7) carbons in length, but these backbones also have short chain branches of only six (6) carbons in length. Such propylene/alpha-olefin copolymers are further described in details in PCT Application No. PCT/US08/082599, incorporated herein by reference.

In some embodiments, the base polymer may comprise ethylene vinyl acetate (EVA) based polymers.

In some embodiments, olefin block copolymers, for example, ethylene multi-block copolymers, such as those described in the International Publication No. WO2005/090427 and U.S. Patent Publication No. 2006/0199930, may be used as the base polymer. An example of a suitable olefin block copolymer includes an ethylene/α-olefin copolymer:

(a) having a Mw/Mn from about 1.7 to about 3.5, at least one melting point, Tm, in degrees Celsius, and a density, d, in grams/cubic centimeter, wherein the numerical values of Tm and d corresponding to the relationship:

$$Tm>-2002.9+4538.5(d)-2422.2(d)^2; \text{ or}$$

(b) having a Mw/Mn from about 1.7 to about 3.5, and being characterized by a heat of fusion, ΔH in J/g, and a delta quantity, ΔT, in degrees Celsius defined as the temperature difference between the tallest DSC peak and the tallest CRYSTAF peak, wherein the numerical values of ΔT and ΔH having the following relationships:

$$\Delta T>-0.1299(\Delta H)+62.81 \text{ for } \Delta H \text{ greater than zero and up to 130 J/g,}$$

$$\Delta T\geq 48^\circ \text{ C. for } \Delta H \text{ greater than 130 J/g,}$$

wherein the CRYSTAF peak being determined using at least 5 percent of the cumulative polymer, and if less than 5 percent of the polymer having an identifiable CRYSTAF peak, then the CRYSTAF temperature being 30° C.; or (c) being characterized by an elastic recovery, Re, in percent at 300 percent strain and 1 cycle measured with a compression-molded film of the ethylene/α-olefin copolymer, and having a density, d, in grams/cubic centimeter, wherein the numerical values of Re and d satisfying the following relationship when ethylene/α-olefin copolymer being substantially free of a cross-linked phase:

$$Re>1481-1629(d); \text{ or}$$

(d) having a molecular fraction which elutes between about 40° C. and about 130° C. when fractionated using TREF, characterized in that the fraction having a molar comonomer content of at least 5 percent higher than that of a comparable random ethylene copolymer fraction eluting between the same temperatures, wherein said comparable random ethylene copolymer having the same comonomer(s) and having a melt index, density, and molar comonomer content (based on the whole polymer) within 10 percent of that of the ethylene/α-olefin copolymer; or (e) having a storage modulus at 25° C., G'(25° C.), and a storage modulus at 100° C., G'(100° C.), wherein the ratio of G'(25° C.) to G'(100° C.) being in the range of about 1:1 to about 9:1.

In certain embodiments, the ethylene/α-olefin copolymer may also:

(a) have a molecular fraction which elutes between about 40° C. and about 130° C. when fractionated using TREF, characterized in that the fraction having a block index of at least 0.5 and up to about 1 and a molecular weight distribution, Mw/Mn, greater than about 1.3; or (b) have an average block index greater than zero and up to about 1.0 and a molecular weight distribution, Mw/Mn, greater than about 1.3, The base polymer may be present in the aqueous dispersion in an amount sufficient for a particular application. In certain embodiments, the base polymer (e.g., a non-polar polyolefin) may be comprise about 30% to about 99% by weight of the combined amount of the base polymer and stabilizing agent. All individual values and subranges from about 30% to about 99'N) are included herein and disclosed herein; for example, the base polymer may be present from a lower limit of about 40%, about 50%, about 60%, about 70%, about 80%, or about 90% to an upper limit of about 40%, about 50%, about 60%, about 70%, about 80%, or about 90%, For example, the base polymer (e.g., a non-polar polyolefin) may be comprise about 60% to about 95% by weight of the combined amount of the base polymer and stabilizing agent, alternatively, about 70% to about 90% by weight of the combined amount of the base polymer and stabilizing agent, or, alternatively, about 85% by weight of the combined amount of the base polymer and stabilizing agent, Embodiments of the aqueous dispersions present in the coating compounds of the present invention also comprise a stabilizing agent, Examples of suitable stabilizing agents include a surfactant, a polymer having a polar group as either a comonomer or a grafted monomer, and mixtures thereof. Examples of surfactants that may be useful as a stabilizing agent in the embodiments of the present invention include cationic surfactants, anionic surfactants, and non-ionic surfactants, Examples of suitable anionic surfactants include sulfonates, carboxylates, and phosphates. Quaternary amines are examples of suitable cationic surfactants, Examples of suitable non-ionic surfactants include block copolymers containing ethylene oxide and silicone surfactants. Surfactants useful as stabilizing agents in embodiments of the present invention may be either external surfactants or internal surfactants. In general, external surfactants are surfactants being part of the dispersed base polymer but that should not become chemically reacted into the polymer during preparation of the aqueous dispersion. Examples of external surfactants useful as a stabilizing agent in embodiments of the present invention include salts of dodecyl benzene sulfonic acid and lauryl sulfonic acid salt. In general, internal surfactants are surfactants that should become chemically reacted into the polymer during preparation of the aqueous dispersion. An example of an internal surfactant useful as a stabilizing agent in embodiments of the present invention includes 2,2-dimethylol propionic acid and its salts.

The polymer used as a stabilizing agent in embodiments of the present invention should be different than the base polymer. An example of a suitable polymer comprises a polar polyolefin. Specific examples of polymer olefins include ethylene-acrylic acid (EAA) and ethylene-methacrylic acid copolymers, such as those available under the tradenames PRIMACOR™, Nucrel™, and Eseor™ polymers and described in U.S. Pat. Nos. 4,599,392, 4,988,781, and 5,938,437, each of which is incorporated herein by reference. Other polymers include ethylene ethyl acrylate (EFA) copolymer, ethylene methyl methacrylate (EMMA), and ethylene butyl acrylate (EBA). Those having ordinary skill in the art, with the benefit of this disclosure, will recognize that a number of other polymers may also be used in accordance with embodiments of the present invention.

If the polar group of the polymer is acidic or basic in nature, the stabilizing polymer may be partially or fully neutralized with a neutralizing agent to form the corresponding salt, in certain embodiments. For example, for EAA, the neutralizing agent may be a base, such as ammonium hydroxide or potassium hydroxide. In another embodiment, the neutralizing agent may be, for example, an amine such as monoethanolamine or 2-amino-2-methyl-1-propanol (AMP). Those having ordinary skill in the art will appreciate that the selection of an appropriate neutralizing agent depends on a number of factors, including the specific composition formulated.

In certain embodiments, an optional base may be included in the aqueous dispersion. Examples of bases that may be used include alkaline metals and alkaline earth metals, such as sodium, potassium, calcium, strontium, barium; inorganic amines, such as hydroxylamine; organic amines, such as methylamine, ethylamine, ethanolamine, cyclohexylamine, tetramethylammonium hydroxide; oxide, hydroxide, and hydride of alkaline metals and alkaline earth metals such as sodium oxide, sodium peroxide, potassium oxide, calcium hydroxide, strontium hydroxide, barium hydroxide, sodium hydride, potassium hydride, calcium hydride; and weak acid salts of alkaline metals and alkaline earth metals such as sodium carbonate, potassium carbonate, sodium hydrogencarbonate, potassium hydrogencarbonate, calcium hydrogencarbonate, sodium acetate, potassium acetate, calcium acetate; or ammonium hydroxide. In certain embodiments, the base may comprise a hydroxide of an alkaline metal or a hydroxide of an alkali metal. In some embodiments, the base may comprise potassium hydroxide, sodium hydroxide, or a combination thereof. By way of example, sufficient base may be added to the aqueous dispersion to neutralize the resultant dispersion to achieve a pH range of about 6 to about 14. All individual values and subranges from about 6 to about 14 are disclosed; for example, from a lower limit of about 8, about 10, or about 12 to an upper limit of about 8, about 10, or about 12. For example, sufficient base may be added to maintain a pH of about 9 to about 12.

The aqueous dispersion further comprises a liquid medium in which the solid materials may be dispersed. Examples of suitable liquid mediums include water, such as deionized water. The amount of the liquid medium may be controlled so that the solids content is about 1% to about 74% by volume of the aqueous dispersion. All individual values and subranges from about 1% to about 74% by volume are included herein and disclosed herein; for example, from a lower limit of about 20%, about 40%, or about 60% to an upper limit of about 30%, about 50%, or about 70%. For example, the solids content of the aqueous dispersion may be about 25% to about 74% by volume and, alternatively, about 30% to about 50% by volume.

Aqueous dispersions formed in accordance with embodiments of the present invention may be characterized, for example, as having an average particle size of between about 0.3 to about 3.0 microns. All individual values and subranges from about 0.3 to about 3.0 microns are included herein and disclosed herein; for example, from a lower limit of about 0.5, about 1.0, or about 2.0 to an upper limit of about 1.0 or about 2.0 For example, dispersions may have an average particle size of about 0.8 microns to about 1.2 microns.

Example Techniques for Preparing the Aqueous Dispersion

To prepare the aqueous dispersion, any of a variety of suitable techniques may be utilized, in accordance with embodiments of the present invention. In one embodiment, a base polymer and a stabilizing agent may be melt-kneaded in an extruder optionally along with water and a neutralizing agent, such as ammonia, potassium hydroxide, or a combination of the two to form the aqueous dispersion. Those having ordinary skill in the art will recognize that a number of other neutralizing agents may be used.

A variety of different melt-kneading machines may be used, including a kneader, a Banbury mixer, single-screw extruder, or a multi-screw extruder. An example of a suitable process for melt-kneading the above-mentioned components is described in U.S. Pat. No. 5,756,659 and U.S. Pat. No. 6,455,636, the disclosures of which are incorporated herein by reference. An example of a suitable melt-kneading machine includes a multi-screw extruder having two or more screws, to which a kneading block may be added at any position of the screws. The extruder, for example, may be provided with a first material supplying inlet and a second material supplying inlet, a third material supplying inlet, and a fourth material supplying inlet from the upper stream to the down stream along the flow direction of the material to be kneaded. Further, a vacuum tent may be added at an optional position of the extruder. In some embodiments, the dispersion may be first diluted to contain about 1% to about 3% by weight of water and then further diluted to contain greater than 25% by weight of water. In some embodiments, further dilution may provide a dispersion with at least about 30% by weight of water.

Referring now to FIG. 1, an extrusion apparatus that may be used in embodiments of the present invention is illustrated, in the illustrated embodiment, extruder 10 is coupled to pressure control device 20. Extruder 10 may be, for example, a multi-screw extruder, Examples of suitable pressure control devices include back pressure regulators, melt pump and gear pumps. Embodiments of the extrusion apparatus also may include a base reservoir 30 and an initial water reservoir 40, each of which may include a pump (not shown), In operation, desired amounts of base and initial water may be provided from the base reservoir 30 and the initial water reservoir 40, respectively. Any suitable pump may be used, but in some embodiments a pump that can provide a flow of about 150 cc/min at a pressure of 240 bar may be used to provide the base and initial water to extruder 10. In another embodiment, a liquid injection pump may be used to provide a flow of 300 cc/min at 200 bar or 600 cc/min at 133 bar. In some embodiments, the base and initial water are preheated in a preheater.

As illustrated in FIG. 1, the base polymer, for example, in the form of pellets, powder, or flakes, may be fed from feeder 50 to an inlet 60 of extruder 10 where the base polymer may be melted and compounded. In some embodiments, a dispersing agent may be added along with the base polymer and, in other embodiments, a dispersing agent may be provided separately to extruder 10. The base polymer may be delivered from the mix and convey zone to an emulsification zone where the initial amount of water and the base are supplied from the base reservoir 30 and the initial water reservoir 40 through inlet 70. In some embodiments, a dispersing agent may be added additionally or exclusively to the water. In some embodiments, the emulsified mixture may be further diluted with additional water from additional water reservoir 80 via additional water inlet 90 in a dilution and cooling zone of extruder 10. The dispersion may be diluted to, for example, at least 30% weight percent water in the dilution and cooling zone. The diluted mixture may be diluted any number of times until the desired level of dilution is reach. In some embodiments, water is not added to extruder 10, but rather to a stream containing the polymer melt after the melt has exited extruder 10. This may be desired, for example, to reducer steam pressure build up in extruder 10.

In some embodiments, a base or aqueous solution, dispersion, or slurry thereof, may be added to the dispersion at any point of the process, for example, in extruder 10. The basic substance may be added, for example, as an aqueous solution. In some embodiments, the basic substance may be added in other forms, such as pellets or granules. In some embodiments, the basis substance and water may be added through separate inlets of extruder 10, Examples of Wetting Agents In addition to the aqueous dispersion, the coating compounds of the present invention may comprise a wetting agent. Among other things, the wetting agent should have the capability to change the wettability of the yarn and the carpet backings to allow deeper penetration of the coating compound into the carpet. Deeper penetration should allow for improved consolidation of individual fibers within the yarn and bonding between yarns, preventing undesirable fraying. Selection of an appropriate wetting agent is important to prevent the undesired coagulation of the base polymer in the aqueous dispersion. Accordingly, the wetting agent selected for use in embodiments of the coating compound should be compatible with the aqueous dispersion, In general, wetting agents are a surfactant or surfactants that should allow a liquid to spread more evenly over, or to penetrate, a solid surface. Examples of suitable wetting agents include ionic surfactants, such as fatty acid salts, fluorotelomers, nonionic surfactants, such as polyethers, silicon-based molecules, and combinations thereof. An alkyl sulfosuccinate is one example of a fatty acid salt that may be useful a wetting agent, in accordance with embodiments of the present invention. An example of an alkyl sulfosuccinate includes sodium di-octyl sulfosuccinate, which is commercially available under the tradename Emulsogen SF8 from Clariant. Examples of a particularly suitable fluorocarbons are the ZONYL® fluorosurfactants, available from E.I. du Pont de Nemours and Company, including ZONYL® FSA and FSN fluorosurfactants. Additional examples of particular wetting agents include Zetasperse additives, Envirogem® additives, Surfynol® additives, Dynol™ additives, and Carbowet® additives, available from Air Products and Chemicals. Suitable wetting agents are available from a variety of suppliers, including Air Products and Chemicals, Inc., Ciba. Inc., Hoechst. AG, Dow Corning, and Clariant.

Where alkyl sulfosuccinates are used, the wetting agent may be present, for example, in the coating compound in an amount of about 0.1 to about 5 parts per hundred parts ("pphp") dry polymer (0.1% to about 5% by weight of the dry polymer), alternatively, an amount of about 0.4 to about 2 pphp dry (0.4% to about 2% by weight of the dry polymer), and alternatively, an amount of about 0.7 to about 1.2 pphp dry (0.7% to about 1.2% h weight of the dry polymer). In one embodiment, the wetting agent comprises sodium di-octyl sulfosuccinate present in the coating compound in an amount of about 0.55 to about 0.60 pphp dry.

Where flurosurfactants are used the wetting agent may be present, for example, in the coating compound in an amount of about 0.025 to about 1.5 pphp dry (0.05% to about 3% by weight of the dry polymer, for ZONYL® FSN fluorosurfactants), alternatively, an amount of about 0.025 to about 0.75 pphp dry (0.05% to about 1.5% by weight of the dry polymer, for ZONYL® FSN fluorosurfactants), and alternatively, an amount of about 0.1 to about 0.5 pphp dry (0.2% to about 1.% by weight of the dry polymer, for ZONYL® FSN fluorosurfactants).

Examples of Optional Coating Compound Components

Those of ordinary skill in the art, with the benefit of this disclosure will appreciate that a variety of different optional components may include in the coating compounds of the present invention as deemed appropriate. Examples of such optional components include fillers, dispersing agents, foaming agents, defoaming agents, and an additional liquid medium. In accordance with embodiments of the present invention, the optional components may be included in the coating compounds during preparation of the aqueous dispersion, after preparation of the dispersion but before addition of the wetting agent, simultaneously with the addition of the wetting agent, or after addition of the wetting agent.

Embodiments of the coating compounds of the present invention may comprise an optional filler. Alternatively, embodiments of the coating compounds may be essentially free of a filler, i.e., containing a filler in an amount of less than about 5% by weight of the coating compound. In certain embodiments, embodiments of the coating compounds may be free of a filler, i.e., containing a filler in an amount of 0% by weight of the coating compound. Where used, among other things, the filler may be included to lower cost of the composition and to increase viscosity. Examples of suitable fillers include milled glass, calcium carbonate, aluminum trihydrate, talc, bentonite, antimony trioxide, kaolin, fly ash, combinations thereof, or other known fillers. In some embodiments, the filler may be present in the coating compound in an amount of about 0% to about 90% by weight of the coating compound. All individual values and subranges from about % to about 90% are included herein and disclosed herein; for example, from a lower limit of about 20%, about 40%, about 60%, or about 80% to an upper limit of about 30#, about 50%, or about 70%. For example, the filler may be present in an amount of about 0% to about 35% by weight and, alternatively, about 0% to about 10% by weight. A filler-to-base-polymer ratio may be, for example, about 0.1:100 to about 45:1, alternatively about 0.1:100 to about 1:1, and alternatively about 0.1:100 to about 1:4.5. Those of ordinary skill in the art, with the benefit of this disclosure, will recognize that inclusion of the filler may impact the transparency of the coating compound on the carpet.

Embodiments of the coating compounds of the present invention may comprise an optional dispersing agent. Examples of suitable dispersing agents include polyacrylate dispersing agents, such as Na-polyacrylate salt. One example of a suitable dispersing agent is available under the tradename Dispex® N40 dispersing agent, available from Ciba Specialty Chemicals. In some embodiments, the dispersing agent may be present in the coating compound in an amount of about 0.013 to about 3.8 pphp dry (0.01% to about 3% by weight for Dispex® N40), alternatively, an amount of about 0.06 to about 1.9 pphp dry (0.05% to about 1.5% by weight for Dispex® N40), and alternatively, an amount of about 0.125 to about 0.625 pphp dry (0.1% to about 0.5% by weight for Dispex® N40).

Embodiments of the coating compounds of the present invention may comprise an optional defoaming agent, A defoamer may be used to prevent or reduce the undesired formation of foam due, for example, to the inclusion of the wetting agent in the coating compounds. Where used, the defoaming agent may be added to the coating compound prior to the wetting agent, for example. Examples of suitable defoaming agents include non-ionic defoaming agents, such as fumed silicas, ethoxylated polysilanes, and combinations thereof. One example of a suitable defoaming agent is available under the tradename Surfynol® DF-70 additive, available from Air Products and Chemicals, Inc. In some embodiments, the defoaming agent may be present in the coating compound in an amount of about 0.1 to about 6 pphp dry polymer (about 0.05% to about 3% by weight of the coating compound). All individual values and subranges from about 0.1 to about 6 pphp dry polymer are included herein and disclosed herein; for example, from a lower limit of about 0.5 pphp, about 1 pphp, about 3 pphp, or about 5 pphp to an upper limit of about 1 pphp, 3 pphp, or about 5 pphp. For example, the defoaming agent may be present in an amount of about 0.1 to about 3 pphp dry polymer (about 0.05% to about 1.5% by weight) and alternatively, about 0.2 to about 1 pphp dry polymer (about 0.1% to about 0.5% by weight).

Embodiments of the coating compounds of the present invention may comprise an optional foaming agent. A foaming agent may be used to foamed system, for example, where it is desired to apply the coating compounds of the present invention to the carpet as a foamed system. Where used, the foaming agent may be added to the coating compound prior to the wetting agent, for example. Examples of suitable foaming agents include sulfates, succinamates, sulfosuccinomates, and combinations thereof. An example of a particular foaming agent includes sodium lauryl sulfates. One example of a suitable foaming agent is available under the Disponil SLS35, available from Cognis. Other suitable suppliers of a foaming agent include Clariant, Henkel, and Ciba, for example. In some embodiments, the foaming agent may be present in the coating compound in an amount of about 0.007 to about 2.1 pphp dry polymer (about 0.01% to about 3% by weight of the coating compound). All individual values and subranges from about 0.007 to about 2.1 pphp dry polymer are included herein and disclosed herein; for example, from a lower limit of about 0.01 pphp. 0.05 pphp, 0.1 pphp, 0.5 pphp, or 1.0 pphp to an upper limit of about 0.5 pphp, 1.0 pphp, or 1.5 pphp. For example, the foaming agent may be present in an amount of about 0.035 to about 1.05 pphp dry polymer (about 0.05% to about 1.5% by weight) and alternatively, in an amount of about 0.2 to about 0.7 pphp dry polymer (about 0.3% to about 1% by weight).

Furthermore, additional liquid medium may be included in the coating compounds, in accordance with embodiments of the present invention. Tap water or deionized water may be used in certain embodiments. Where used, the additional liquid medium may be present in an amount of 0 to about 80 pphp of the dispersion. All individual values and subranges from 0 to about 88 pphp of the dispersion are included herein and disclosed herein. For example, the additional liquid medium may be present in an amount of about 5 to about 35 pphp of the dispersion. By way of example, additional water of about 5 to about 35 pphp of the dispersion would result in a final solids content of about 50% to about 35% for a dispersion having an initial solids content of about 52%.

When a foamed system is desired, the coating compounds may be frothed by way of a gas as a frothing agent. Examples of suitable frothing agents include gases, such as air, carbon dioxide, nitrogen, argon, helium, and mixtures thereof. The frothing agent, for example, may be introduced into the coating compound by mechanical introduction of a gas into a liquid to form a froth, commonly referred to as "mechanical frothing" When preparing a foamed system, all the components of the coating compound may be combined, prior to blending the gas therewith. Examples of equipment that may be used to form the foamed system include an OAKES, MONDO, or FIRESTONE frother, Those ordinary skill in the art, with the benefit of this disclosure, will appreciate that the coating compounds of the present invention may be prepare in accordance with any of a variety of techniques. In some embodiments, the components of the coating compounds may be combined in the following order: aqueous dispersion, defoaming agent, additional water, wetting agent, dispersing agent, and filler. If foaming is not desired, the defoaming agent may be added to the aqueous dispersion first. In some embodiments, the components of the coating compounds may be combined in the following order: aqueous dispersion, foaming agent, additional water, wetting agent, and eventually dispersing agent, and filler. If foaming is desired, the foaming agent may be added to the aqueous dispersion first.

Examples of Application of Coating Compound to Carpet

In accordance with embodiments of the present invention, the coating compounds of the present invention may be applied to carpet to achieve, among other things carpet that is more resistant to fraying, a transparent, non-tacky film on the carpet, and enhanced resistance to stains, Among other things, the transparency of the film to visible light may be enhanced, in that the film does not show the Tyndall effect. In general, the enhanced fray resistance may be attributed to improved penetration of the coating compounds in the yarn, as well as good adhesion of the composition to apolar substrates and good cohesion in the film formed from the coating compound.

The coating compounds of the present invention may be applied to a carpet using any of a variety of suitable techniques, By way of example, the coating compounds may be applied to carpet by a lick-roll application or by direct spread of a foam with a doctor's knife. Additionally, the coating compounds also may be applied to the carpet by way of a spray-coating process. Those of ordinary skill in the art, with the benefit of this disclosure, will recognize other suitable techniques for application of the coating compounds to the carpet. In certain embodiments, the coating compound may be applied as a layer of preferably uniform thickness onto the non-pile surface of a carpet substrate. The film may have a thickness, for example, of about 0.5 microns to about 500 microns. All individual values and subranges from about 0.5 microns to about 500 microns are included herein and disclosed herein. For example, the film may have a thickness of about 10 microns to about 300 microns. Precoats, laminate coats, and foam coats of the coating compounds may be prepared using any of a variety of methods for preparing polymer backed carpets. Precoats, laminate coats, and foam coats prepared from aqueous dispersions are described in more detail in P. L. Fitzgerald, "Integral Dispersion Foam Carpet Cushioning," J, Coat, Fab. 1977, vol. 7 (pp. 107-120) and in R. P. Brentin, "Dispersion Coating Systems for Carpet Backing," J. Coat, Fab. 1982, vol. 12 (pp. 82-91).

Due to the improved penetration and bonding, it is believed that less of the base polymer may be required to achieve the desired bonding. By way of example, the coating compound of the present invention may be applied in an amount of about 10 to about 800 dry grams/$m^2$. All individual values and subranges from about 10 to about 800 dry grams/$m^2$ are included herein and disclosed herein. For example, the base polymer may be present in an amount of about 75 to about 250 dry grams/$m^2$ or alternatively, in an amount of about 75 to about 250 dry grams/$m^2$. Higher strength may be obtained, even though less of the base polymer is used, The woven carpet coated with the coating compound should show a greater resistance to fraying and velveting, in accordance with embodiments of the present invention. By way of example, the fray resistance may be characterized qualitatively as a slip fray based on the resistance to being pulled exhibited by a warp or fill yarn closed to the edge of a carpet sample cut from the coated woven carpet. To characterize the fraying resistance in a more quantitative way, one can measure the force needed to pull out an outer warp or Outer Warp Pull force (OWPF). The OWPF obtained with carboxylated SB is measured to be 4.7 kg or less. In certain embodiments, the OWPF of a woven carpet is greater than about 5.0 kg, alternatively greater than about 5.5 kg, or alternatively greater than about 6.0 kg.

Once the coating compound of the present invention is applied to the carpet, the composition may be dried using any suitable technique. Examples of suitable drying techniques include air drying, convection oven drying, hot air drying, microwave oven drying, and/or infrared oven drying. The coating compound applied to the carpet may be dried at any temperature, for example, it may be dried at a temperature equal to or greater than the melting point of the base polymer or, alternatively, it may be dried at a temperature equal to or less than the melting point of the base polymer. The coating compound applied to the carpet may be dried at a temperature of from about 20° C. less than to about 150° C. higher than the melting point of the base polymer, alternatively dried at a temperature about 10° C. less than to about 5° C. higher than the melting point of the base polymer, alternatively at a temperature about 5° C. less than to about 10° C. higher than the melting point of the base polymer, provided that the water of the coating compound can fully evaporate from the film. Drying the coating compound at a temperature equal to or greater than the melting point of the base polymer should facilitate formation of a film having a continuous base polymer phase with a discrete stabilizing agent dispersed therein with the continuous base polymer phase improving oil and grease resistance, as well as providing a barrier to moisture and vapor transmission in absence of the Tyndall effect. In order to assure that the base polymer, used to make the adhesive film, has melted completely the dry film should remain at this temperature for at least about 1 second, alternatively at least about 10 seconds, and alternatively at least about 30 seconds.

By way of example, a coating compound applied to the carpet may be dried at a temperature of about 60° F. (15.5° C.) to about 700° F. (371° C.), All individual values and subranges from about 60° F. (15.5° C.) to about 700° F. (371° C.) are included herein and disclosed herein. For example, the coating compound applied to the carpet may be dried at a temperature of about 60° F. (15.5° C.) to about 500° F. (260° C.) or alternatively, about 60° F. (15.5° C.) to about 450° F. (232.2° C.) By way of further example, a coating compound applied to the carpet may be dried at a temperature of about 60° F. (15.5° C.) to about 392° F. (200° C.), alternatively, about 122° F. (50° C.) to about 302° F. (150° C.), or alternatively, about 158° F. (70° C.) to about 248° F. (120° C.).

To facilitate a better understanding of the present invention, the following examples of certain aspects of some embodiments are given. In no way should the following examples be read to limit, or define, the entire scope of the invention.

EXAMPLES

Raw Materials Used in the Example Experiments

Carboxylated SB latex A (XZ 92219.00) is latex that is used for woven applications with a relative hard handle. The latex has a solids content of 50.5%, a pH of 7.0, a dynamic viscosity at 25° C. of 250 cP and a particle size of 140 nm. The polymer has a Styrene content of 60% and a Tg of 12° C.

Carboxylated latex B (XZ 92229.03) is a latex that is used for woven applications with a relative soft handle. The latex has a solids content of 52%, a pH of 8.0, a dynamic viscosity at 25° C. of 240 cP and a particle size of 150 nm. The polymer has a Styrene content of 52.5 and a Tg of −23° C.

DPOD 4501 Developmental polyolefin dispersion is aqueous acid-modified propylene polymer based polyolefin dispersion with a solids content of 42%, a pH of 9.5 and a dynamic viscosity at 25° C. of 500 cP.

DPOD 4502 Developmental polyolefin dispersion is aqueous acid-modified propylene polymer based polyolefin dispersion with a solids content of 42.5%, a pH of 9.5 and a dynamic viscosity at 25° C. of 450 CP.

DPOD 4503 Developmental polyolefin dispersion is aqueous acid-modified propylene polymer based polyolefin dispersion with a solids content of 53%, a pH of 9.5 and a dynamic viscosity at 25° C. of 1000 cP.

Example 1

Experiments may be performed to determine wet fray resistance, pile wire resistance, and break-through. To do these, a flat woven carpet, consisting of polypropylene weft, pile wire, and warp yarn, is used that has a dimension of approx 20×30 cm and weighs approx 65 grams. Such carpet has a weight of approx 1200 g/m$^2$. The weight is recorded as $W_0$, The carpet is placed with the backside up. In a Mylar film of 20×30 cm, a round of 1 dm$^2$ is cut by means of a punch, positioned off centre from 15-25 cm of the length. The Mylar film is placed over the carpet and taped at top side to fix it. A calibration bar with a slit of 0.5 mm is placed on the Mylar film.

Different compositions are prepared for application to the carpet. Samples 1 and 2 are carboxylated styrene-butadiene latex A, sample 1 being diluted to obtain a lower % solids. Samples 3 and 4 are carboxylated styrene-butadiene latex B. Sample 5 is a polyolefin dispersion (DPOD 4501), Sample 6 is a polyolefin dispersion (DPOD 4503), The composition is prepared as described and an amount is brought in front of the calibration bar. Initially 15 grams, but later 8-10 grams latex, is applied to the plastic sheet (Mylar film) and smeared cross the round circle by means of a calibration bar with a gap of 500 or 625 microns. The sheet with residual latex is removed and the carpet is weighed to determine the applied wet weight.

0=Uncoated reference woven carpet, resistance to Slip fray is practically zero.

1=Coated carpet, resistance to Slip fray is negligible.

2=Coated carpet, resistance to Slip fray is somewhat present, but relatively easy to pull.

3=Coated carpet, resistance to Slip fray is present, but not sufficient for heavy traffic usage.

4=Coated carpet, resistance to Slip fray is significant, strong pulling is needed to slip the warp or filling out.

5=Coated carpet, resistance to Slip fray is maximum, manual slipping is practically impossible.

Pile Fray resistance is reported qualitatively on a scale from 0 to 5. Pile yarns are the decorative yarns that velvet easily. Perpendicular to the cutting edge a hard metal side is rubbed (e.g., with back side of a key). The relative force to induce velveting is reported. The Pile fray resistance is qualitatively expressed with following scale:

0=Uncoated Reference woven carpet, resistance to velveting is practically zero.

1=Coated carpet, resistance to velveting is negligible. Slight rubbing is sufficient to cause the side of the carpet to velvet.

2=Coated carpet, resistance to velveting is somewhat present. Some rubbing is needed to velvet the Pile yarn, 3=Coated carpet, resistance to velveting is present, but not sufficient for heavy traffic. Extensive rubbing or hard rubbing creates velveting, 4=Coated carpet, resistance to velveting is significant. Extensive hard rubbing creates velveting.

5=Coated carpet, resistance to velveting is maximum. Extensive hard rubbing does not create velveting.

The results from this series of tests are provided in Table 1 below:

TABLE 1

| Sample | 1a | 1b | 2A | 2B | 3A | 3b | 4a | 5a | 5b | 6a | 6b |
|---|---|---|---|---|---|---|---|---|---|---|---|
| Type | Carbox. SB Latex A | | | | Carbox. SB Latex B | | | DPOD 4501 | | DPOD 4503 | |
| % Solids | 40 | 40 | 50 | 50 | 50 | 50 | 50 | 50 | — | 50 | — |
| Bar Gap (micron) | 625 | 500 | 625 | 625 | 625 | 625 | 500 | 625 | 500 | 625 | 500 |
| Given Amt (g) | 15 | 15 | 10 | 15 | 8 | 8 | 8 | 8 | 8 | 10 | 10 |
| Applied Wet (g) | 5.4 | 4 | 3.4 | 4.9 | 5.3 | 5.7 | 4.2 | 3.3 | 3.6 | 4.1 | 3.5 |
| Applied Wet (g/m$^2$) | 540 | 400 | 340 | 490 | 530 | 570 | 420 | 330 | 360 | 410 | 350 |
| Slip Fray (slip) Resistance | 3 | 2 | 1 | 2 | 3 | 3 | 2 | 4 | 4 | 4 | 4 |
| Pile Fray Resistance | 2 | 1 | 1 | 2 | 2 | 2 | 2 | 3 | 3 | 4 | 3 |
| Break Through | + | +/− | − | + | +/− | +/− | − | − | − | +/− | − |

After 10-30 minutes leaving at room temperature, the carpet is observed for break-through. In Table 1, a − means NO, and + means YES as to whether break-through is observed. The carpet is subsequently dried in an oven at 120 degrees for 10 minutes. Finally the applied rounds are cut with scissors to examine the cutting edge resistance to fraying.

Slip Fray resistance is reported qualitatively on a scale from 0 to 5. The first available Warp of Filling yarn, next to the cut is isolated before it is pulled laterally away from Filling respectively Warp yarns. The slipping force is qualitatively expressed according to the following ascending scale:

Table 1 illustrates the qualitative observations if a woven polypropylene carpet is coated with both carboxylated SB latexes, developed for such application, and bonding agent compositions that comprise aqueous polyolefin dispersions. The data of Samples 1 and 2 illustrate that a higher coat weight typically is believed to result in more resistance to Slip and Pile fraying. Similarly, a higher solid is believed to have fewer tendencies for Break Through. A different carboxylated SB latex (Samples 3 and 4 vs. 1 and 2) can have better resistance to Slip and Pile Fraying, Samples 5 and 6 illustrate that a lower coat weight of a DPOD has a better resistance to Slip and Pile Fraying in comparison to the reference carboxylated SB latexes.

Example 2

Based on the observations from Example 1, a second series of tests is performed more uniformly to obtain similar total solids, and to see the effect of surface tension reduction.

This series of test is a more controlled repeat of the tests from Example 1, with addition of another DPOD and wetting agent. In addition, surface tension of the latex and dispersion are tested as well as color testing of the coated carpet.

Figure 3:
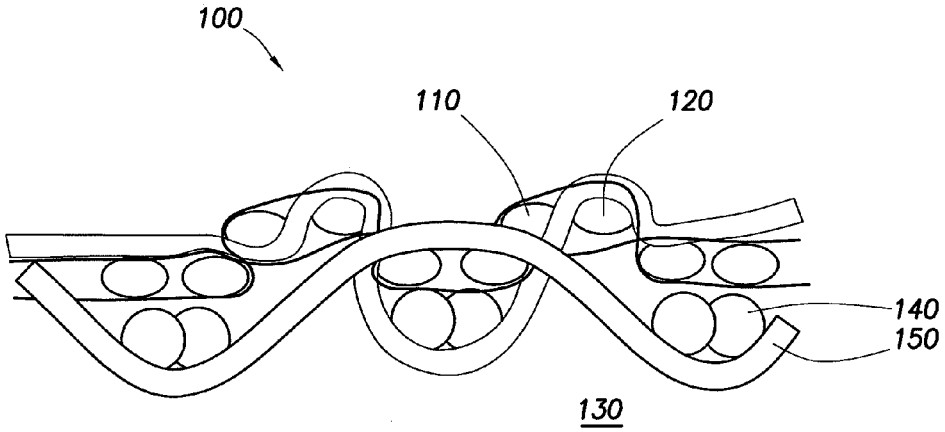
FIG. 3 illustrates another view of a flat woven carpet that may be used in accordance with embodiments of the present invention.
Figure 2:
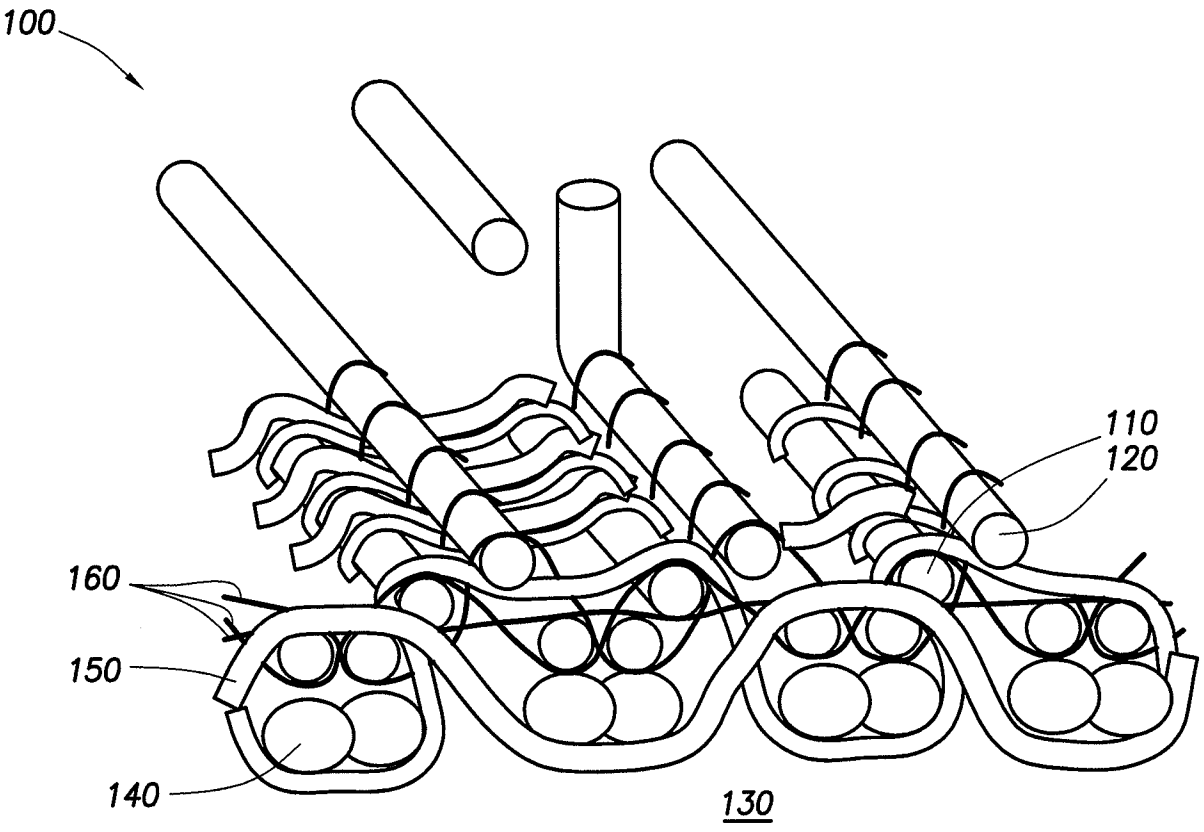
FIG. 2 illustrates a flat woven carpet that may be used in accordance with embodiments of the present invention.
Figure 4:
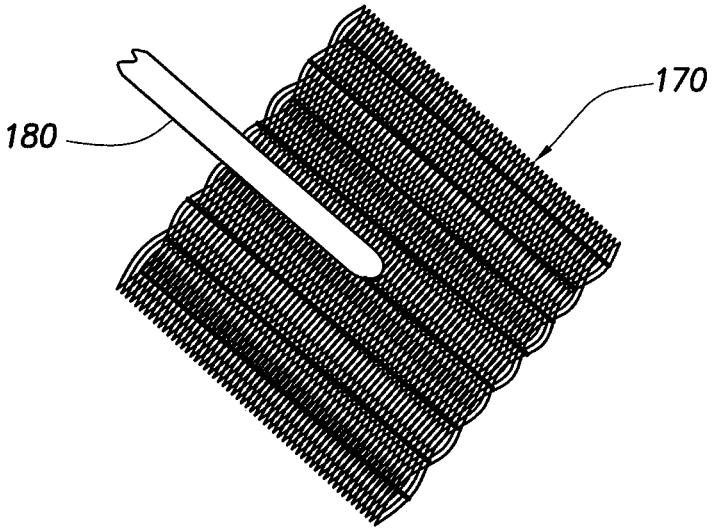
FIGS. 4 and 5 illustrate a technique for measuring the force needed to pull a warp yarn from a woven carpet in accordance with embodiments of the present invention.

A flat woven carpet, consisting of polypropylene Warp, Pile and Filling (=weft) yarns, has a dimension of approximately 20×30 cm and weighs approx 60 grams, such carpet has a weight of approx 1200 g/m2. FIGS. 2-4 illustrate a flat woven carpet having first warp 110, second warp 120, pile warps 140, fillings 150, and base fillings 160. Exact weight is recorded, $W_0$.

The carpet is placed with the backside up. In a Mylar film of 20×30 cm a round of 1 $dm^2$ is cut by means of a punch, positioned off centre from 15-25 cm of the length. The Mylar film is placed over the carpet and taped at top side to fix it. A calibration bar with a slit of 500 micrometers is placed on the Mylar film.

Different compounds are prepared for application to the carpet. Sample 7 is carboxylated styrene-butadiene latex A, diluted with water to a total solids of 42.0%. Sample 8 is carboxylated styrene-butadiene latex B, diluted with water to a total solids of 42.0%. Sample 9 is a polyolefinic dispersion (DPOD 4501), diluted with water to a total solids of 42.0%. Sample 10 is a polyolefinic dispersion (DPOD 4502), diluted with water to a total solids of 42.0%. Sample 11 is a polyolefinic dispersion (DPOD 4503), diluted with water to a total solids of 42.0%. Sample 12 comprises 100 parts of a polyolefinic dispersion (DPOD 4503), 4.3 parts of a wetting agent (Emulsogen SF8), and 26.2 parts water. This results in a compound with 42.1% solids and 0.57 dry parts Emulsogen SF8 per hundred dry parts polymer.

The compounds are prepared as described, and an amount of the compound is brought in front of the calibration bar. With continuous speed the calibration bar is moved forward, over the punched round, to deposit compound on the carpet where the Mylar was round cut. The wetting behavior of the compound during application is observed and recorded qualitatively. The Mylar sheet with the residual compound is removed from the carpet. The carpet is turned upside down to avoid further penetration from gravity and weighed again. The upside is judged for break through of the latex or dispersion compound. Applied wet weight is recorded as: $W_1-W_0=W_{wet}$.

The carpet is placed in the oven at prescribed temperature for the prescribed time. The carpet is cooled down and weight is measured again to obtain the dry weight. After minimum 2 hours, cuts are made parallel, perpendicular and diagonally to the warp. The cutting edges are judged qualitatively for Slip-fray resistance and Pile-fray resistance as described in Example 1.

The results from this series of tests are provided in Table 2 below:

TABLE 2

| Sample | 7a | 7b | 8a | 8b | 9a | 9b | 10a | 10b | 11a | 11b | 12a | 12b |
|---|---|---|---|---|---|---|---|---|---|---|---|---|
| Type | Carbox. SB A | | Carbox. SB B | | DPOD 4501 | | DPOD 4502 | | DPOD 4503 | | | |
| Emulsogen SF8, parts dry | — | | — | | — | | — | | — | | 0.57 | |
| % Solids | all diluted to 42% solids | | | | | | | | | | | |
| Bar Gap (microns) | 500 | | | | | | | | | | | |
| Given Amt (g) | 15 to 20 grams applied in application bar | | | | | | | | | | | |
| Applied Wet (g) | 5.6 | 4.62 | 5.06 | 4.42 | 4.11 | 3.02 | 3.5 | 3.6 | 4 | 3.97 | 4.29 | 9.15 |
| Applied Wet ($g/m^2$) | 560 | 462 | 506 | 442 | 411 | 302 | 350 | 360 | 400 | 397 | 429 | 915 |
| Wet Break Through | +/− | − | + | +/− | − | − | − | − | − | − | − | − |
| Wetting | ok | ok | ok | ok | +/− | +/− | − | − | − | − | ok | ok |
| Surface Tension (mN/m) | 46.2 | | 33.3 | | 49 | | 47 | | 51.5 | | 38 | |
| Applied Dry Weight ($g/m^2$) | 205 | 192 | 189 | 173 | 154 | 92 | 83 | 145 | 102 | 135 | 105 | 403 |
| Slip Fray Resistance | 1 | 1 | 1 | 1 | 3 | 2 | 3 | 3 | 2 | 3 | 4 | 5 |
| Pile Fray Resistance | 1 | 1 | 2 | 2 | 3 | 3 | 3 | 3 | 3 | 3 | 4 | 5 |
| Dry Break Through | +/− | − | + | +/− | +/− | +/− | +/− | +/− | − | +/− | +/− | ++ |
| Color (L, a, b) | | | | | | | | | | | | |
| L*(100 = white) | 53.3 | 54.7 | 53.8 | 53.4 | 52.6 | 52.8 | 52.7 | 52.6 | 52.8 | 52.3 | 48.7 | 51.5 |
| a*(+ = red, − = green) | 6.7 | 6.5 | 6.5 | 7.1 | 7.3 | 7.1 | 7.6 | 7.5 | 7.3 | 7.3 | 7.4 | 7.3 |
| b*(+ = yellow, − = blue) | 16.5 | 16.8 | 16.7 | 17.4 | 17.5 | 17.3 | 18.4 | 18.3 | 18.3 | 18.1 | 17.2 | 17.7 |

Table 2, it can be concluded that different carboxylated SB latexes can improve somewhat the Pile-Fraying resistance. Polyolefin dispersions have much better resistance to Slip fraying and Pile Fraying, even at lower application weight. Carboxylated SB latex B shows more tendency to break through and shows somewhat better Pile-Fray resistance. This is believed to be predominantly caused by the lower surface tension. Sample 12a vs. 11a demonstrates that addition of wetting agent can further improve the Slip- and Pile-Fray resistance, Sample 11b vs. 11a shows the variation in properties that can be observed at equally applied wet coating weight. Sample 12b vs. 12a shows that absolute coat weight also determines final properties. Slip-, and Pile-Fray resistance have increased to the maximum qualitatively observable level as well as the dry break through have increased. The color with polyolefin coating appears rather bright than dull, as can be observed with carboxylated SB, The Tyndall effect is not present.

Example 3

Figure 5:
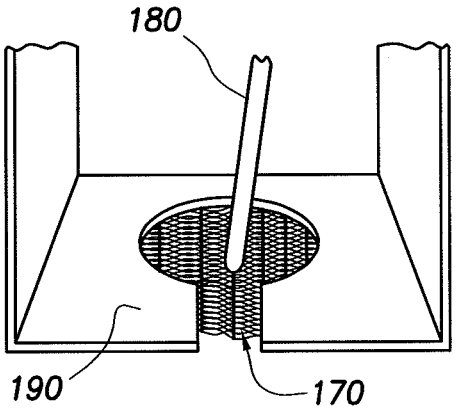

To provide quantitative results, a test method is developed which measured the force needed to pull out the warp yarn from the woven carpet. These measurements are performed on the same carpet samples from Example 2, As illustrated by FIGS. 2 and 3, at the backside 100 of the carpet, there are the light-colored continuous Warps, e.g., as indicated by first warp 110 and second warp 120. At the frontside or faceside 130 there are the decorative, darker-colored Pile warps 140. The warps are bound by the pile fillings 150 and the base fillings 160. Among the warps, we can identify at the surface are the outer warp, sub-surface warp, and two inner warps. The inner warps are carrying the Pile warps. As illustrated by FIG. 4, the carpet 170 is cut such, that a 3.5 cm long outer warp is isolated, from which 1 cm is unraveled, using thin tweezers 180, to allow sufficient length for the tuft-lock grip. As illustrated by FIG. 5, the tuft-lock grip 190 is placed over the full free Outer Warp (OWPF) length and hung into the Tuft lock meter (not shown). Subsequently, the force to pull out the Warp is measured. As the carpet deformed using this test using the normal metal positioning device, the carpet is held down by means of a large scissors, positioned at both sides of the tuft lock grip.

The results from this series of tests are provided in Table 3 below:

TABLE 3

| Sample | 7a | 7b | 8a | 8b | 9a | 9b | 10a | 10b | 11a | 11b | 12a | 12b |
|---|---|---|---|---|---|---|---|---|---|---|---|---|
| Type | Carbox. SB A | | Carbox. SB B | | DPOD 4501 | | DPOD 4502 | | DPOD 4503 | | | |
| Emulsogen SF8, parts dry | — | | — | | — | | — | | — | | 0.57 | |
| Applied Dry Weight (g/m$^2$) | 205 | 192 | 189 | 173 | 154 | 92 | 83 | 145 | 102 | 135 | 105 | 403 |
| Outer Warp | | | | | | | | | | | | |
| Measurement 1 | 5.1 | 3.8 | 4.0 | 3.9 | 5.6 | 6.1 | 7.5 | 8.5 | 8.2 | 7.1 | 7.5 | 8.6 |
| Measurement 2 | 4.6 | 3.4 | 3.8 | 4.1 | 8.5 | 6.3 | 9.6 | 8.8 | 7.8 | 6.1 | 7.0 | 9.1 |
| Measurement 3 | 4.7 | 3.2 | 3.6 | 3.5 | 7.4 | 5.1 | 9.8 | 9.4 | 7.5 | 5.7 | 7.5 | 9.5 |
| Measurement 4 | 4.3 | 3.5 | 3.6 | 3.3 | 7.0 | 5.7 | 9.4 | 8.5 | 7.8 | 6.1 | 7.4 | 9.5 |
| Measurement 5 | — | — | — | — | — | — | — | — | — | — | — | 9.3 |
| Mean OWPF, (kg) | 4.7 | 3.5 | 3.8 | 3.7 | 7.0 | 5.8 | 9.1 | 8.8 | 7.8 | 6.3 | 7.4 | 9.2 |
| SD | 0.3 | 0.3 | 0.2 | 0.4 | 1.2 | 0.5 | 1.1 | 0.4 | 0.3 | 0.6 | 0.2 | 0.4 |
| Var. Coefficient (%) | 7 | 7 | 5 | 10 | 17 | 9 | 12 | 5 | 4 | 10 | 3 | 4 |

From Table 3, it can be concluded that different carboxylated SB latexes show no significant difference in Outer Warp Pull Force, similar coat weights results in similar OWPF for two different latexes. Polyolefin dispersions have much better Warp Pull resistance than SB latex, even at lower application weight, as evidenced from the higher OWPF. Improvement of the penetration of the POD by the wetting agent to be proven with Inner Warp Pull Force (IWPF). POD 4502 shows highest OWPF in comparison to other POD types.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. In particular, every range of values (of the form, "from about a to about b," or, equivalently, "from approximately a to b," or, equivalently, "from approximately a-b") disclosed herein is to be understood as referring to the power set (the set of all subsets) of the respective range of values, and set forth every range encompassed within the broader range of values. Also, the terms in the claims have their plain, ordinary meaning unless otherwise explicitly and clearly defined by the patentee.

What is claimed is:

1. A woven carpet comprising:

a woven substrate; and an adhesive layer comprising a dehydration product of a coating compound, and said adhesive layer formed from:

an aqueous dispersion comprising a base polymer, a stabilizing agent, and water, wherein the base polymer comprises a polyolefin-based polymer; and from 0.4 to 2 pphp of an alkyl sulfosuccinate wetting agent;

wherein said aqueous dispersion is free of fillers;

wherein said woven carpet is characterized by an outer warp pull force of at least about 5.0 kilograms.

2. The woven carpet according to claim 1, wherein the woven carpet does not include a serge strip.

3. The woven carpet according to claim 1, wherein the woven carpet is characterized by absence of the Tyndall effect.

4. The woven carpet according to claim 1, wherein the woven carpet comprises yarns made from a polyolefin.

5. The woven carpet according to claim 1, wherein the aqueous dispersion is present in the coating compound in an amount of about 65% to about 100% by weight of the coating compound.

6. The woven carpet according to claim 1, wherein the base polymer comprises at least one polymer selected from the group consisting of a polyethylene-based copolymer, a polypropylene-based copolymer, and an ethylene-propylene copolymer.

7. The woven carpet according to claim 1, wherein the base polymer comprises a propylene/alpha-olefin copolymer.

8. The woven carpet according to claim 1, wherein the base polymer comprises a propylene/alpha-olefin copolymer characterized as having substantially isotactic propylene sequences and comprising from about 1 to about 40 percent by weight of one or more alpha-olefin comonomers.

9. The woven carpet according to claim 1, wherein the base polymer comprises ethylene vinyl acetate-based polymers.

10. The woven carpet according to claim 1, wherein the base polymer comprises about 30% to about 99% by weight of the combined amount of the base polymer and the stabilizing agent.

11. The woven carpet according to claim 1, wherein the stabilizing agent comprises a neutralized polar polyolefin, wherein the polar polyolefin is different than the base polymer.

12. A method of preparing a woven carpet comprising:
applying a coating compound as an adhesive layer to the woven carpet to form a coated woven carpet, wherein the coating compound comprises:
an aqueous dispersion comprising a base polymer, a stabilizing agent, and water, wherein the base polymer comprises a polyolefin-based polymer; and
from 0.4 to 2 pphp of an alkyl sulfosuccinate wetting agent;
wherein said aqueous dispersion is free of fillers; and
drying the coated woven carpet to form a woven carpet;
wherein said woven carpet is characterized by an outer warp pull force of at least about 5.0 kilograms.

13. The woven carpet according to claim 12, wherein the coating compound comprises at least one additive selected from the group consisting of a dispersing agent, a foaming agent, a defoaming agent, and combinations thereof.

14. A method of preparing a woven carpet comprising:
applying a coating compound as an adhesive layer to the woven carpet to form a coated woven carpet, wherein the coating compound comprises:
an aqueous dispersion comprising a base polymer, a stabilizing agent, and water, wherein the base polymer comprises a polyolefin-based polymer; and
from 0.025 to 1.5 pphp of a fluorosurfactant wetting agent;
wherein said aqueous dispersion is free of fillers; and
drying the coated woven carpet to form a woven carpet;
wherein said woven carpet is characterized by an outer warp pull force of at least about 5.0 kilograms.

15. A woven carpet comprising:
a woven substrate; and
an adhesive layer comprising a dehydration product of a coating compound, said adhesive layer formed from:
an aqueous dispersion comprising a base polymer, a stabilizing agent, and water, wherein the base polymer comprises a polyolefin-based polymer; and
from 0.025 to 1.5 pphp of a fluorosurfactant wetting agent;
wherein said aqueous dispersion is free of fillers;
wherein said woven carpet is characterized by an outer warp pull force of at least about 5.0 kilograms.

* * * * *